US009506709B2

(12) United States Patent
Esposito et al.

(10) Patent No.: US 9,506,709 B2
(45) Date of Patent: Nov. 29, 2016

(54) GUN DETECTION SYSTEM AND METHOD TO PREVENT SCHOOL AND BUSINESS SHOOTINGS

(71) Applicants: David Wayne Esposito, Winsted, CT (US); Lawrence E. Rode, Terryville, CT (US)

(72) Inventors: David Wayne Esposito, Winsted, CT (US); Lawrence E. Rode, Terryville, CT (US)

( * ) Notice: Subject to any disclaimer, the term of this patent is extended or adjusted under 35 U.S.C. 154(b) by 44 days.

(21) Appl. No.: 14/589,069

(22) Filed: Jan. 5, 2015

(65) Prior Publication Data

US 2015/0194033 A1 Jul. 9, 2015

Related U.S. Application Data

(60) Provisional application No. 61/924,100, filed on Jan. 6, 2014.

(51) Int. Cl.

| | |
|---|---|
| ***G08B 21/00*** | (2006.01) |
| ***F41A 17/06*** | (2006.01) |
| ***G08B 15/00*** | (2006.01) |
| ***G08B 21/02*** | (2006.01) |
| *G07C 9/00* | (2006.01) |

(52) U.S. Cl.

CPC ..... *F41A 17/063* (2013.01); *G08B 15/00* (2013.01); *G08B 21/02* (2013.01); *G07C 9/00111* (2013.01)

(58) Field of Classification Search

CPC . F41A 17/063; G07C 9/00111; G08B 15/00; G08B 21/02

See application file for complete search history.

(56) References Cited

U.S. PATENT DOCUMENTS

| | | | | |
|---|---|---|---|---|
| 5,416,486 | A * | 5/1995 | Koert | G01S 13/758 342/42 |
| 7,167,123 | B2 | 1/2007 | Hausner et al. | |
| 8,319,694 | B2 | 11/2012 | Yang et al. | |
| 8,378,988 | B1 * | 2/2013 | Artino | H04N 7/186 235/382 |
| 2006/0208857 | A1 | 9/2006 | Wong | |
| 2013/0133234 | A1 | 5/2013 | Eftekharzadeh | |
| 2014/0173959 | A1 | 6/2014 | Kountotsis et al. | |
| 2014/0173960 | A1 | 6/2014 | Kountotsis et al. | |
| 2015/0007741 | A1 * | 1/2015 | Nath | F42B 12/36 102/430 |
| 2015/0077255 | A1 * | 3/2015 | Pallotta | F41A 17/063 340/572.1 |

FOREIGN PATENT DOCUMENTS

| | | |
|---|---|---|
| WO | 2014057464 | 4/2014 |

* cited by examiner

*Primary Examiner* — Mark Rushing

(74) *Attorney, Agent, or Firm* — Ware, Fressola, Maguire & Barber LLP

(57) ABSTRACT

A gun detection system and method to prevent school and business shootings is provided that is capable of detecting a firearm a significant distance away from the point of entry and triggering response of an alarm and an automatic door locking system.

14 Claims, 5 Drawing Sheets

GUN DETECTION SYSTEM AND METHOD TO PREVENT SCHOOL AND BUSINESS SHOOTINGS

CROSS REFERENCE TO RELATED APPLICATION

This application claims the benefit of U.S. Provisional Application No. 61/924,100, filed Jan. 6, 2014, which is hereby incorporated by reference in its entirety.

FIELD OF THE INVENTION

The present invention relates to a security system for preventing the use or entry of firearms in schools and other buildings.

BACKGROUND OF THE INVENTION

There is a wide spread epidemic of shootings at schools and businesses in the United States. Metal detectors are commonly used at the point of entrance to a building to determine if a person entering is armed. However, metal detectors allow a gun to become too close to the point of entry, where an armed person can do harm. A metal detector will detect a gun, but by then it can be too late to lock a door or sound an alarm, as the gun may be inside the building.

The present invention addresses these problems in the art with a system that is capable of detecting a gun that is a significant distance away from the door, allowing time for an automatic door locking system and alarm to engage.

SUMMARY OF THE INVENTION

According to a first aspect of the present invention, a system is provided comprising a radio frequency identification reader positioned near a building configured to detect a firearm comprising a radio frequency identification tag from within 100 feet of the radio frequency identification reader, an alarm in communication with the radio frequency identification reader and configured to be triggered when the radio frequency identification reader detects a firearm, and an automatic door locking system in communication with the radio frequency identification reader and configured to lock doors of the building when the radio frequency identification reader detects a firearm.

In certain embodiments of the present invention, the radio frequency identification reader can be secured to a structure positioned on or near the building, or can be a hand-held device. The radio frequency identification reader comprises a long-range ultrahigh frequency antenna. The radio frequency identification reader is configured to detect a radio frequency identification tag attached to or embedded in a firearm, including in a firearm ammunition clip.

The radio frequency identification reader according to the system of the present invention can be configured to alert a third party or to activate a security system when the radio frequency identification reader detects a firearm.

The system according to the invention may further include at least a second radio frequency identification reader in communication with both the alarm and the automatic door locking system and positioned near the building, configured to detect a firearm comprising a radio frequency identification tag from as far as 100 feet away from the at least second radio frequency identification reader, wherein the alarm is further configured to be triggered and the automatic door locking system is further configured to lock the doors of the building when the at least second radio frequency identification reader.

The system according to the invention may comprise a central computing device configured to communicate with and control the operation of the radio frequency identification reader, the alarm and the automatic door locking system.

The system according to the present may further comprise a device comprising a memory that stores a software application, wherein the device is in communication with the radio frequency identification reader and the software application is configured to execute an action when the radio frequency identification reader detects a firearm. The system according to the present invention may further comprise a transceiver configured to receive a signal from the radio frequency identification reader that the firearm has been detected and to transmit a signal to each of the alarm and the automatic door locking system instructing the alarm and the automatic door locking system to activate.

According to a second aspect of the invention, a method is provided that comprises detecting, by a radio frequency identification reader, the presence of a firearm comprising a radio frequency identification tag within 100 feet of a building, receiving by an alarm and by an automatic door locking system, a signal indicating that the firearm has been detected by the radio frequency identification reader, triggering the alarm in response to receiving the signal; and locking the doors to the building by the automatic door locking system in response to receiving the signal.

The method according to the invention may further comprise receiving, by a communication device having a receiver, the signal indicating that the firearm has been detected by the radio frequency identification reader, and transmitting, a transmitter of the communication device in response to receiving the signal, an alert message to a third party to inform the third party that the firearm has been detected.

DETAILED DESCRIPTION OF THE INVENTION

Figure 1:
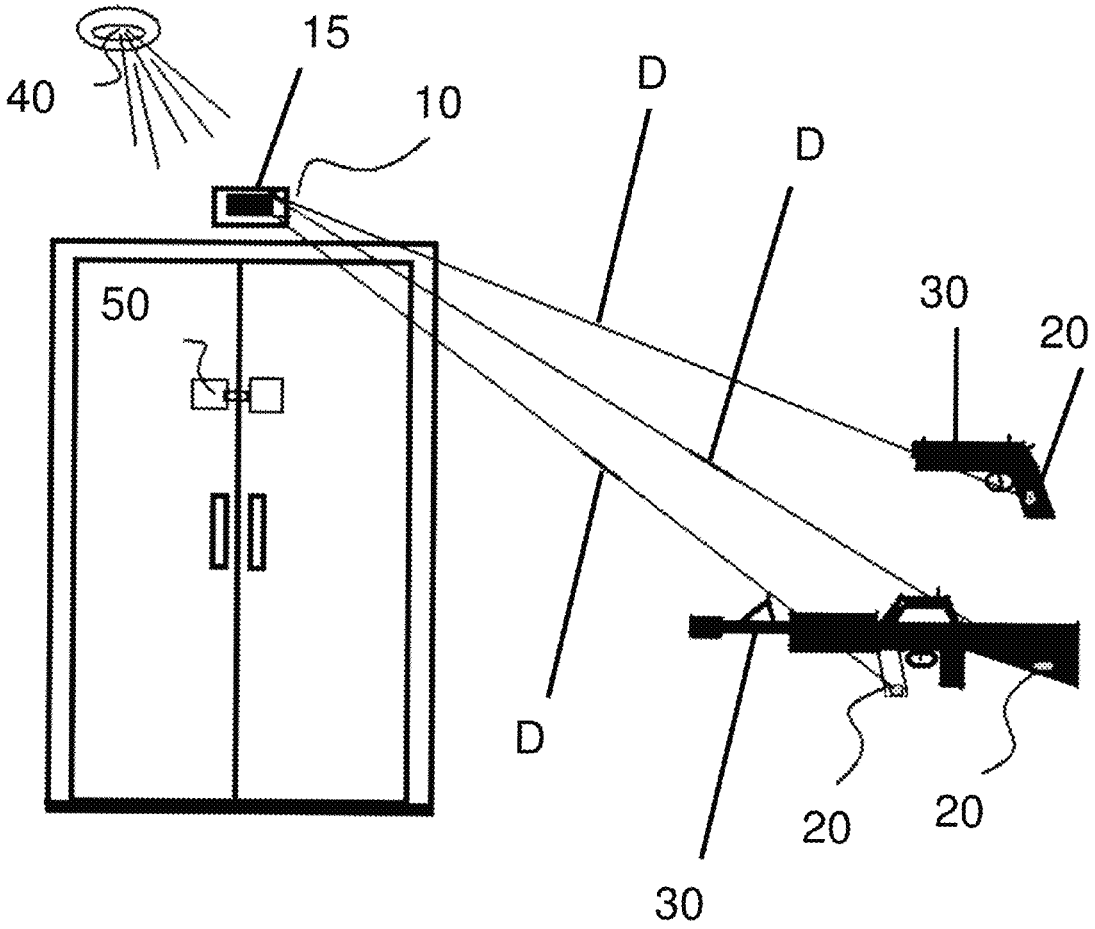
FIG. 1 shows the system of the present invention according to a first embodiment of the invention.

The present invention will now be described with reference made to FIGS. 1 through 6.

According to the present invention, a radio frequency identification ("RFID") reader device 10 is provided in connection with a building, to detect the presence of an RFID tag or tags 20 that are affixed to a firearm 30. When an RFID tag 20 is detected by the RFID reader device 10, the RFID reader device 10 causes an alarm 40 and an automatic door locking system 50 to be activated for the building.

Figure 5:
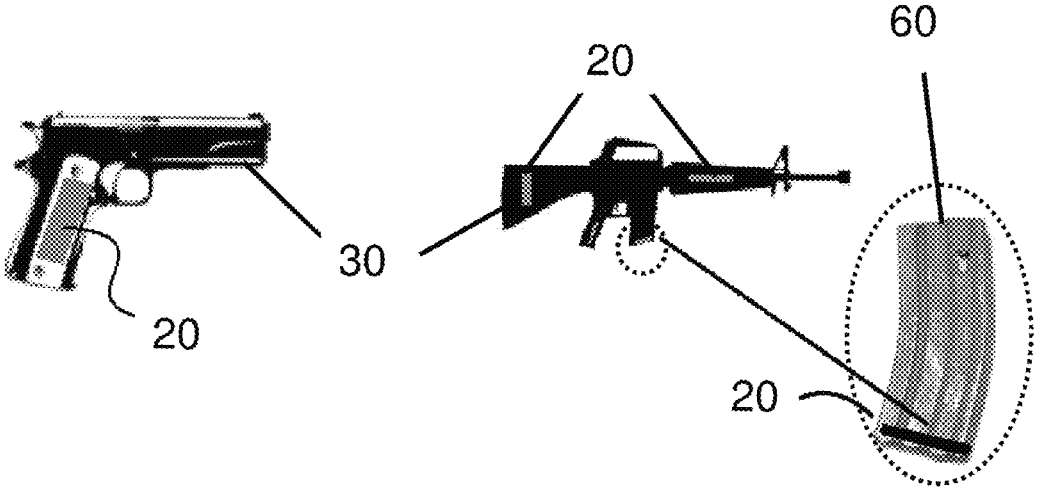
FIG. 5 shows firearms comprising radio frequency identification tags according to the present invention.

The RFID tags 20 are known in the art and are small, inexpensive and abundant. The RFID tags 20 can be concealed in a firearm 30 and/or an ammunition clip 60 during manufacture or by the retailer, as shown in FIG. 5. The RFID tag 20 is programmed to signal to a RFID reader device 10 that the RFID tag 20 is affixed to a firearm 30 or a part of a firearm 30. For purposes of explanation, any reference to a firearm 30 detected by the RFID reader device 10 contained herein refers to the detection of any part of the firearm 30 having an affixed RFID tag 20, including an ammunition clip 60 which may or may not be physically attached to the firearm.

The RFID reader device 10 comprises an ultrahigh frequency ("UHF") antenna 15 that is configured to detect the presence of an RFID tag 20 affixed to a firearm 30 or ammunition clip 60. The antenna 15 is capable of detecting the presence of such an RFID tag 20 that is within a distance D of 100 feet of the antenna 15 in any direction. In alternative embodiments of the present invention, the antenna 15 is capable of detecting an RFID tag 20 from greater distances D than 100 feet.

In a preferred embodiment of the invention, the system operates as follows. If an armed individual approaches a building utilizing the system of the present invention, when the individual enters within 100 feet of the RFID reader device, the concealed RFID tag 20 installed in the firearm 30 is detected. In response to detecting the RFID tag 20, the RFID reader device 10 activates the automatic door locking system 50 for the building. The automatic door locking system 50, when activated, automatically locks the doors to the building to prevent anyone from entering the building from outside, including the armed individual. Upon detecting the RFID tag 20, the RFID reader 10 also activates a warning alarm 40. The warning alarm 40 may include sonic and/or visual alarms, and may also be a system comprising multiple individual alarms that can be installed inside and outside of the building. The warning alarm 40 alerts the armed individual outside of the building that they have been detected, increasing the likelihood that the individual flees the vicinity of the building without ever entering the building. The warning alarm 40 also alerts those inside of the building that an armed individual is approaching, thereby providing them with additional time to take preparatory protective steps, such as locking down individual rooms in the building.

The RFID reader device 10 can vary with respect to the number of devices 10 that are used with a particular building. For example, in a first embodiment shown in FIG. 1, a single RFID reader device 10 can be positioned over the door of the building. The RFID reader device 10 would therefore detect an RFID tag 20 that is within 100 feet of the door to the building.

Figure 2:
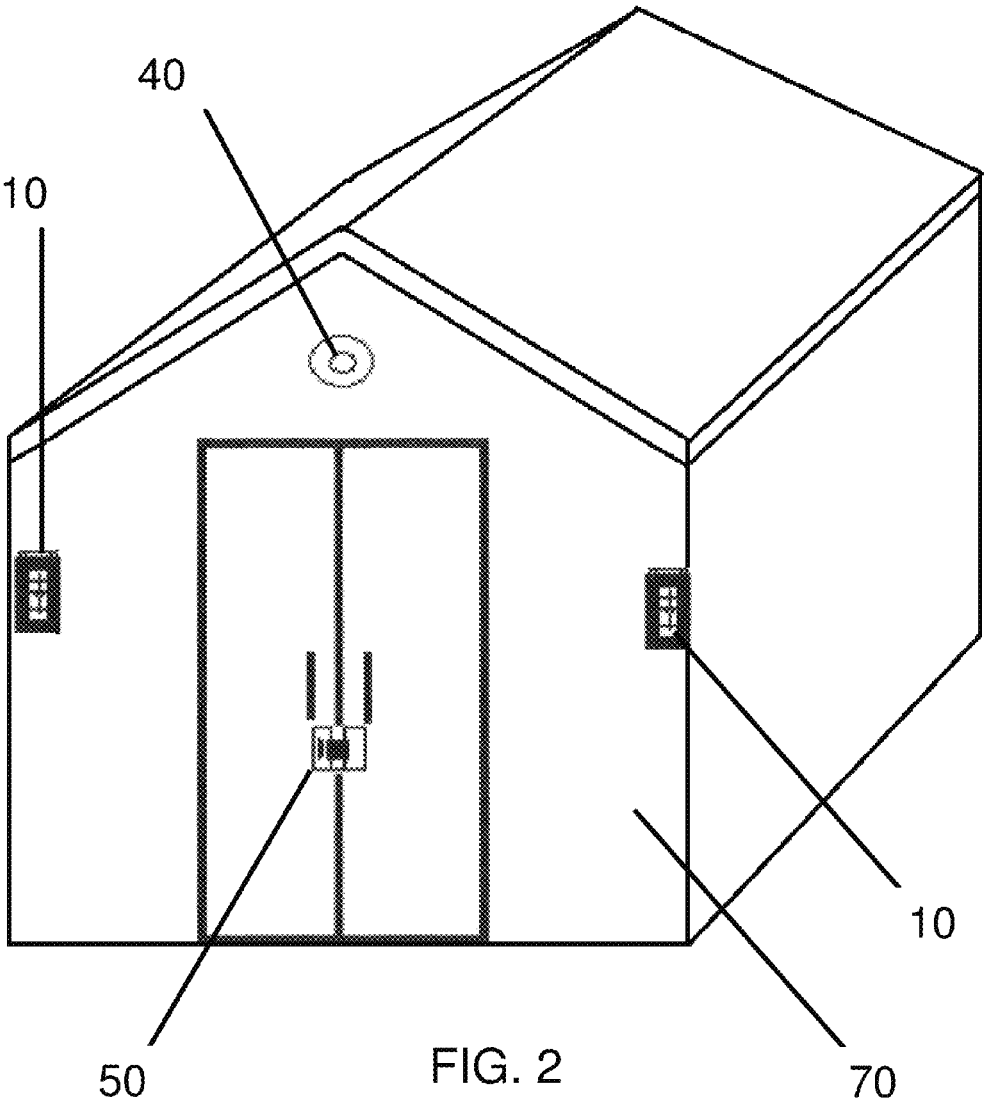
FIG. 2 shows the system of the present invention according to a second embodiment of the invention.

In a second embodiment, shown in FIG. 2, a plurality of RFID reader devices 10 are used and are secured to a wall 70 of the building near the entrance. Because each RFID reader device 10 is configured to detect a RFID tag 20 that is within a certain range, the use of multiple RFID reader devices 10 increases the range in which an RFID tag 20 can be detected. Additionally, in the event that an RFID reader device 10 is non-functional or does not have sufficient power, the use of more than one RFID reader device 10 allows the system to still function by using the other RFID reader devices 10. An RFID reader device 10 is not limited to being secured to any particular, existing structure, but rather, the RFID reader device 10 can be secured to or concealed on any available, existing object or structure on or near a building, including for example support columns, trees, signs, light posts or flag poles.

Figure 3:
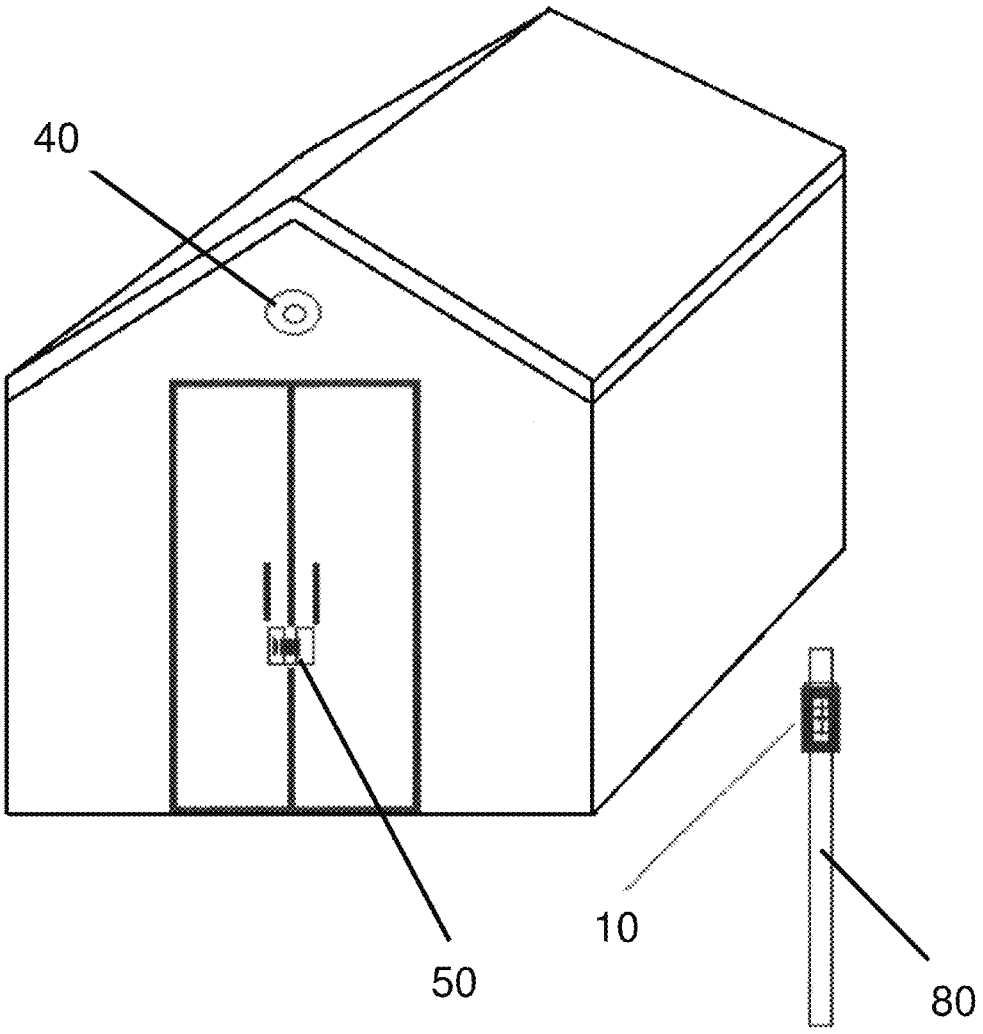
FIG. 3 shows the system of the present invention according to a third embodiment of the invention.

According to a third embodiment, shown in FIG. 3 the RFID reader device 10 can be secured to a support pole 80 that is not part of the pre-existing architecture or landscape of the building, but rather, is installed with the installation of the system for the purpose of supporting the RFID reader device 10. One or more support poles 80 can be installed in the number and locations deemed appropriate for the particular use, and are not limited as such.

Figure 4:
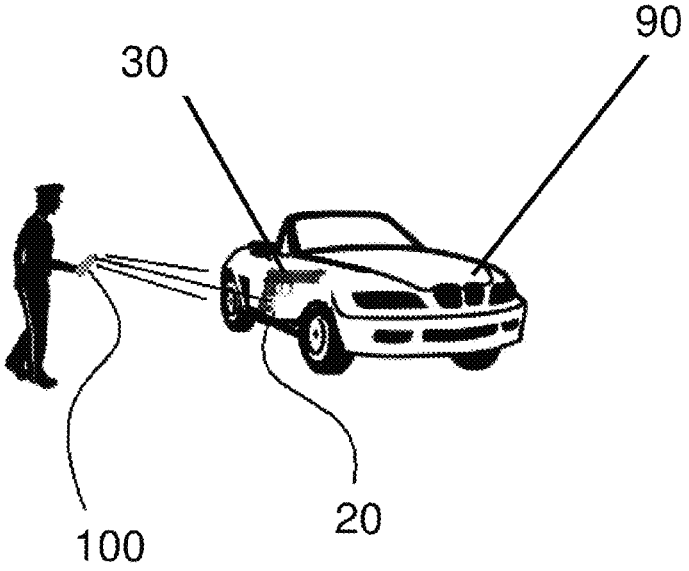
FIG. 4 shows the system of the present invention according to a fourth embodiment of the invention.

According to a further embodiment of the invention, the RFID reader device 10, or at least one of a plurality of RFID reader devices 10 used in the system may be a handheld unit 100, as shown in FIG. 4. The handheld RFID reader device 100 can be used by police officers or other security personnel to detect an RFID tag 20 in the same manner as described above. An individual can use a handheld RFID reader device 100 to detect the presence of a firearm within a distance D (e.g., 100 feet) of the individual. For example, if a building has a large parking lot, a security officer can patrol the parking at with the handheld RFID reader device 100 to detect if an automobile 90 or an individual in an automobile 90 has a firearm 30 inside. The handheld RFID reader device 100 can be configured to implement the same response of activating the warning alarm 40 and automatic door locking system 50 as would be implemented by the RFID reader device 10, or configured to trigger a different response sequence.

Figure 6:
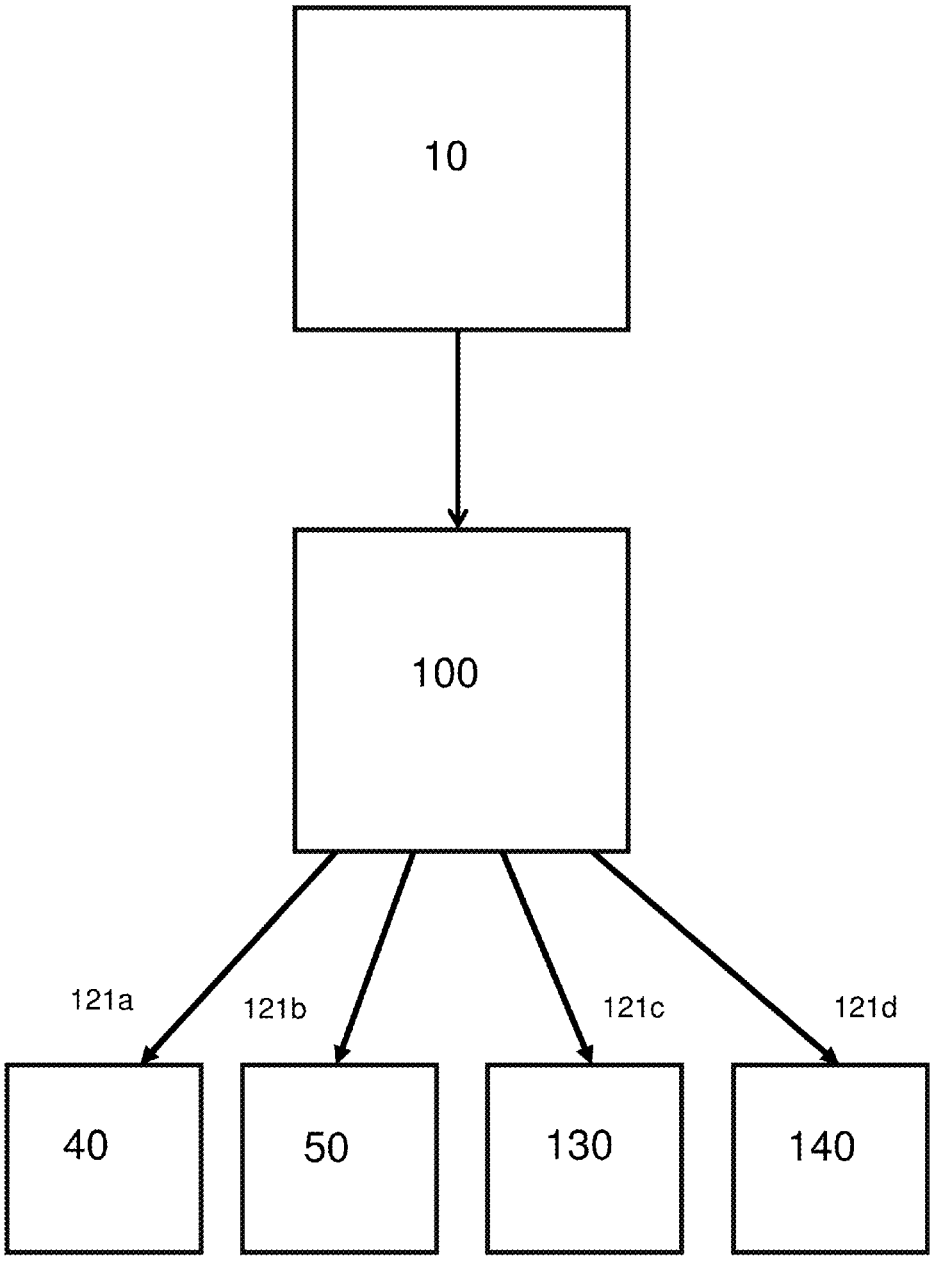
FIG. 6 shows a method and system according to the present invention.

An exemplary method according to the invention is shown in FIG. 6. When an RFID reader device 10 detects the presence of a RFID tag 20, it is configured to transmit to a central processor 110, a signal 120 containing information that the firearm-related RFID tag 20 has been detected. The central processor 110 can be part of the RFID reader device 10 or can be part of an external computing device (not shown), including for example, a computer or mobile device located inside of the building that allows an individual to oversee and manage the RFID reader device 10, warning alarms 40 and automatic door locking system 50. The central processor 110 may comprise a transceiver (not shown) configured to receive and transmit signals, and a memory stored with instructions or a software application that is configured, in combination with a processor, to execute a series of actions when a signal 120 is received. Upon receiving the signal 120, the central processor 110 is configured to transmit a signal 121*a* to the warning alarm 40 instructing the warning alarm 40 to activate. The central processor 110 also simultaneously transmits a signal 121*b* to the automatic door locking system 50 instructing the automatic door locking system 50 to lock the entrance doors to the building.

According to an embodiment of the invention, if the building comprises a security system 130, upon receipt of the signal 120, the central processor 110 can be configured to transmit a signal 121*c* to trigger the security system 130. The security system 130 can be configured to respond to the signal 121*c* in the same manner that the security system 130 may respond to a break in, including for example, sending a transmission to a private security company or law enforcement to indicate that the security system 130 has been activated.

According to a further embodiment of the invention, upon receipt of the signal 120, the central processor 110 transmits a signal 121*d* directly to law enforcement or on- or off-site security personnel to inform the recipient that a firearm 30 has been detected. Alternatively or additionally, the signal 121*d* can be transmitted to a mobile device or a computer inside the budding, such as in the main office or the security office, instructing an individual to contact law enforcement or security personnel.

The warning alarm 40 and the automatic door locking system 50 are configured to be manually deactivated once it has been determined that any threat posed by the detected firearm 30. This can be done for example, using a central control device configured to control operation of at least the alarm 40 and automatic door locking system 50, or using individual control consoles.

According to a further alternative embodiment of the present invention, the RFID tags 20 are further programmed to signal to the RFID reader device 10 if the accompanying firearm 30 belongs to a law enforcement officer. The RFID reader device 10 can be configured to not activate the alarm 40 or automatic door locking system 50 upon detecting the firearm 30 of a law enforcement officer.

According to a further embodiment of the invention, the firearm 30 may be further implanted with a disabling locking device that the RFID reader device 10 can engage to disable the firearm 30.

While there have been shown and described and pointed out fundamental novel features of the invention as applied to preferred embodiments thereof, it will be understood that various omissions and substitutions and changes in the form and details of the devices and methods described may be made by those skilled in the art without departing from the spirit of the invention. For example, it is expressly intended that all combinations of those elements and/or method steps which perform substantially the same function in substantially the same way to achieve the same results are within the scope of the invention. Moreover, it should be recognized that structures and/or elements and/or method steps shown and/or described in connection with any disclosed form or embodiment of the invention may be incorporated in any other disclosed or described or suggested form or embodiment as a general matter of design choice. It is the intention, therefore, to be limited only as indicated by the scope of the claims appended hereto. Furthermore, in the claims means-plus-function clauses are intended to cover the structures described herein as performing the recited function and not only structural equivalents, but also equivalent structures. Thus although a nail and a screw may not be structural equivalents in that a nail employs a cylindrical surface to secure wooden parts together, whereas a screw employs a helical surface, in the environment of fastening wooden parts, a nail and a screw may be equivalent structures.

What is claimed:

1. A system comprising:

a first radio frequency identification reader positioned at a first location a distance away from an entrance to a building, and configured to detect a firearm comprising a radio frequency identification tag;

an alarm in communication with the first radio frequency identification reader and configured to be triggered when the first radio frequency identification reader detects a firearm;

an automatic door locking system in communication with the first radio frequency identification reader and configured to lock doors of the building when the first radio frequency identification reader detects a firearm; and at least a second radio frequency identification reader in communication with both the alarm and the automatic door locking system and positioned at a second location a distance away from the entrance to the building, configured to detect a firearm comprising a radio frequency identification tag, wherein the alarm is further configured to be triggered and the automatic door locking system is further configured to lock the doors of the building when the at least second radio frequency identification reader detects a firearm; and wherein the at least second radio frequency identification reader, in combination with the first radio frequency identification reader is configured to increase the range in which a firearm comprising a radio frequency identification tag can be detected.

2. The system according to claim 1, wherein the either or both of the first and at least second radio frequency identification reader is a hand held device.

3. The system according to claim 1, wherein the first and the at least second radio frequency identification reader are configured to alert a third party when the respective first or at least second radio frequency identification reader detects a firearm.

4. The system according to claim 1, wherein the first and the at least second radio frequency identification reader are configured to activate a security system when the respective first or at least second radio identification reader detects a firearm.

5. The system according to claim 1, wherein the first and the at least second radio frequency identification readers comprise a long-range ultrahigh frequency antenna.

6. The system according to claim 1, wherein the first and the at least second radio frequency identification readers are configured to detect a radio frequency identification tag in a firearm ammunition clip.

7. The system according to claim 1, wherein the first and the at least second radio frequency identification readers are configured to detect a radio frequency identification tag concealed inside of the structure of the firearm.

8. The system according to claim 1, further comprising a central computing device configured to communicate with and control the operation of the first and the at least second radio frequency identification readers, the alarm and the automatic door locking system.

9. The system according to claim 1, further comprising a device comprising a memory that stores a software application, wherein the device is in communication with the first and the at least second radio frequency identification readers and the software application is configured to execute an action when the first and the at least second radio frequency identification readers detect a firearm.

10. The system of claim 1, further comprising a transceiver configured to receive a signal from the first and the at least second radio frequency identification readers that the firearm has been detected and to transmit a signal to each of the alarm and the automatic door locking system instructing the alarm and the automatic door locking system to activate.

11. A method comprising:

detecting, by at least one of a first radio frequency identification reader positioned at a first location a distance from an entrance to a building or an at least second radio frequency identification reader positioned at a second location a distance from the entrance to the building, the presence of a firearm comprising a radio frequency identification tag within 100 feet of the radio frequency identification reader;

in response to said detecting, transmitting a signal from the radio frequency identification reader to an alarm and an automatic door locking system indicating that the firearm has been detected by at least one of the first or at least second radio frequency identification reader;

in response to said alarm receiving said signal, triggering said alarm to provide an audio or visual indicator; and in response to said automatic door locking system receiving said signal, locking the doors to said building;

wherein the at least second radio frequency identification reader, in combination with the first radio frequency identification reader is configured to increase the range in which a firearm comprising a radio frequency identification tag can be detected.

12. The method of claim 11, further comprising:

transmitting a signal from at least one of the first or at least second radio frequency identification reader indicating that the firearm has been detected to a communications device;

wherein said signal transmitted to the communications device instructs the communications device to transmit an alert message to a third party to inform the third party that the firearm has been detected.

13. The system according to claim 1, wherein at least one of the first or at least second radio frequency identification reader and the alarm are secured to a support pole at the distance from the entrance to the building.

14. The system according to claim 13, wherein the alarm comprises a sonic alarm and a visual alarm.

* * * * *